US005607212A

United States Patent [19]

Kilpatrick

[11] Patent Number: 5,607,212

[45] Date of Patent: Mar. 4, 1997

[54] ARTICLE OF FURNITURE WITH FOOTREST MOUNTED PIVOTALLY TO DRAWER

[76] Inventor: Ted D. Kilpatrick, 101 Sea Hammock Way, Ponte Vedra Beach, Fla. 32082

[21] Appl. No.: 542,410

[22] Filed: Oct. 12, 1995

[51] Int. Cl.[6] ..... A47B 83/00

[52] U.S. Cl. ..... 312/237; 312/311; 312/194; 312/184; 297/423.1

[58] Field of Search ..... 248/245, 246, 248/295.11; 297/423.1, 423.39; 108/153; 312/231, 237, 194, 223.3, 295, 235.2, 280, 281, 311, 310, 317.3, 348.5, 184, 26

[56] References Cited

U.S. PATENT DOCUMENTS

| | | | |
|---|---|---|---|
| 470,378 | 3/1892 | Hamblin | 312/295 X |
| 1,398,237 | 11/1921 | Michaels | 312/194 X |
| 1,883,785 | 10/1932 | Hamm | 312/194 X |
| 1,975,779 | 10/1934 | Church | 312/321.5 X |
| 2,731,318 | 1/1956 | Hoff | 312/235.2 X |
| 3,572,873 | 3/1971 | Harting, Jr. | 312/237 X |
| 4,089,573 | 5/1978 | Aeschliman | 312/26 X |
| 4,123,124 | 10/1978 | Peets | 312/26 X |
| 4,898,294 | 2/1990 | Jennings | 312/311 X |
| 5,248,192 | 9/1993 | Tazzia | 312/194 |
| 5,456,369 | 10/1995 | Smed | 312/184 X |

*Primary Examiner*—Peter M. Cuomo
*Assistant Examiner*—James O. Hansen
*Attorney, Agent, or Firm*—Dressler, Goldsmith, Milnamow & Katz, Ltd.

[57] ABSTRACT

An article of furniture with a drawer movable horizontally within a drawer-receiving receptacle, into and from a closed position and through a range of opened positions, is provided with a footrest having an expansive, cushioned, foot-supportive panel. The drawer has an interior space, walls including outer, inner, side walls, and file-hanging rails mounted within the drawer so as to extend between the outer and inner walls or between the side walls, near the other walls, to accommodate file folders with upper hangers extending above the file-hanging rails. The footrest is mounted to one of the outer and side walls so as to be pivotally movable through at least about 90° of pivotal motion, when the drawer is moved sufficiently for the footrest to clear the margin of the drawer-receiving receptacle, from and into a lowered position wherein the footrest extends horizontally so as to cover a substantial part of the interior space, wherein substantially all of the footrest lies beneath the upper plane defined by the upper edges of the side walls, so as to permit the drawer to be horizontally moved into and from the closed position without interference from the footrest, and wherein the footrest is spaced above the file-hanging rails, so as not to interfere with such folders hanging from the file-hanging rails, and through a range of raised positions wherein the footrest allows access to the same part of the interior space.

9 Claims, 1 Drawing Sheet

FIG, 1
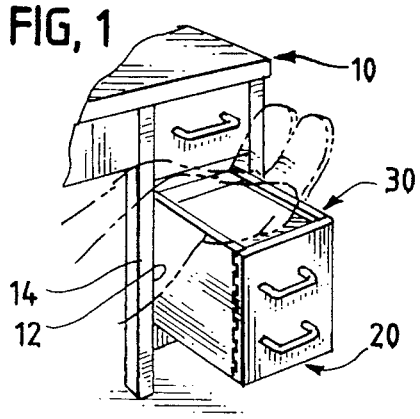
FIG. 2
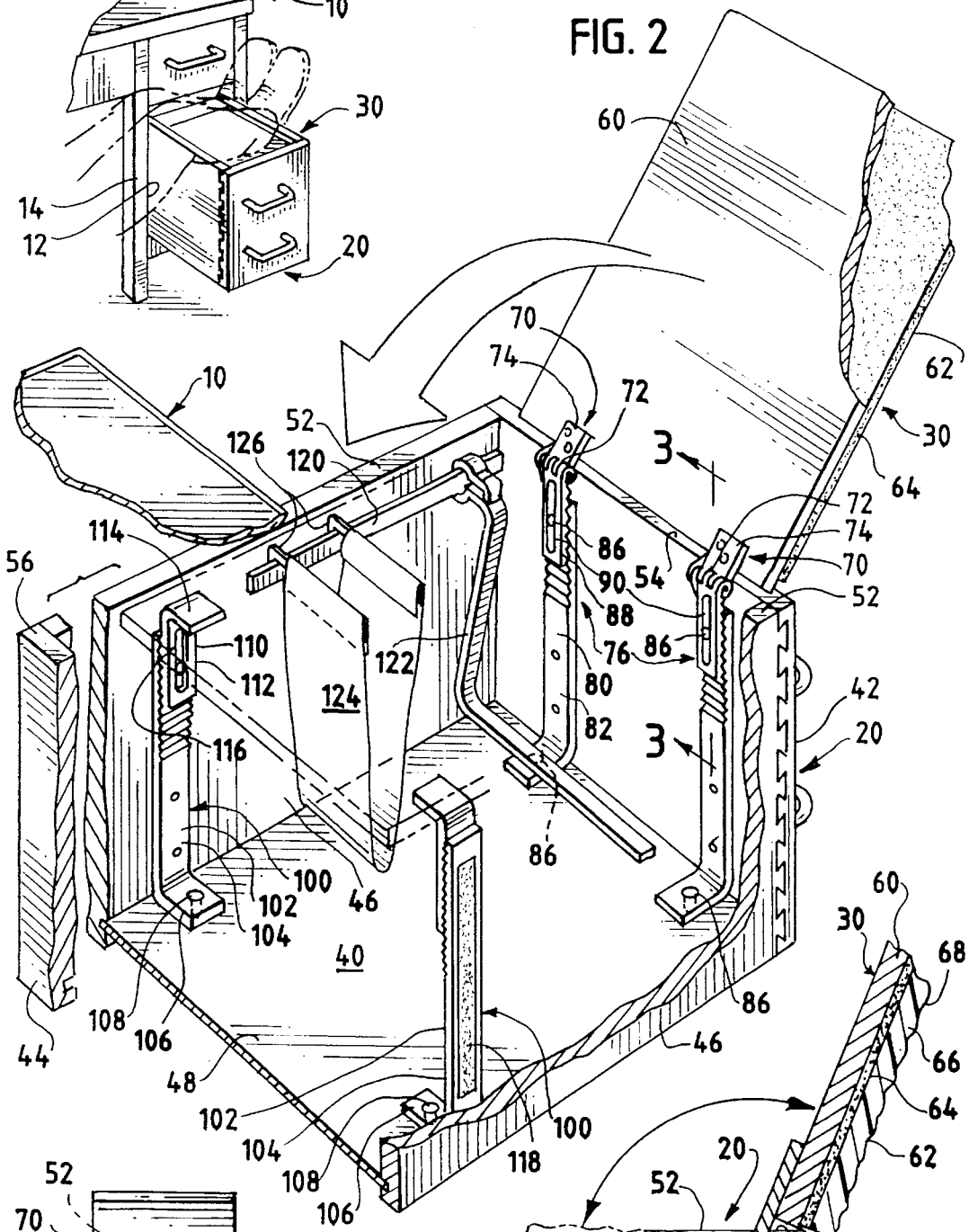

ARTICLE OF FURNITURE WITH FOOTREST MOUNTED PIVOTALLY TO DRAWER

TECHNICAL FIELD OF THE INVENTION

This invention pertains to a combination comprising a desk, credenza, or similar article of furniture and a footrest, which is mounted pivotally to one wall of a drawer.

BACKGROUND OF THE INVENTION

Many persons working in offices spend long hours at their desks and appreciate opportunities to prop up their feet while reading or resting. Frequently, such persons resort to propping up their feed on desk tops, which tend to be too high for many persons, or on drawer edges, which tend to be very uncomfortable, particularly if ottomans are not allowed or do not fit conveniently in their offices. Although prior efforts have been made to equip desks with footrests, those efforts have not been entirely satisfactory.

As disclosed in Davis U.S. Pat. No. 2,986,437, a footrest comprising a cushioned, foot-supportive panel is attachable to a drawer of a desk, via channel members fastened to the footrest and adapted to fit over upper edges of side walls of the drawer. Significant disadvantages of the footrest are that the footrest must be removed before the drawer can be opened or closed and that the footrest must be stored within the drawer or elsewhere.

As disclosed in Kinnebrew U.S. Pat. No. 3,528,717, a footrest comprising a cushioned, foot-supportive panel is mounted within a drawer of a desk, via a mechanism enabling the footrest to be raised to a usage position above the drawer and to be lowered to a storage position for storage within the drawer. The mechanism biases the footrest to the upper position and latches the footrest in the lowered position. A significant disadvantage of the footrest is that the drawer is occupied by the mechanism and by the footrest in the lowered position so that the drawer cannot be put to normal uses of a drawer.

As disclosed in Wilkins U.S. Pat. No. 3,141,701, a footrest comprising a single yoke serving as a foot support or comprising a double yoke serving as two foot supports rests on a desk or is fastened to an upper edge of a drawer. Although the footrest is compact, a significant disadvantage of the footrest is that the footrest is not susceptible to being provided with a cushioned, foot-supportive panel, because of the single or double yoke.

There has been a need, to which this invention is addressed, for a better way to provide a desk, credenza, or similar article of furniture with a footrest having an expansive, foot-supportive panel, which may be cushioned.

SUMMARY OF THE INVENTION

Addressing the need noted above, this invention provides a combination comprising a desk, credenza, or similar article of furniture and a footrest having an expansive, foot-supportive panel, which may be cushioned. The article has a drawer-receiving receptacle having a margin and a drawer movable horizontally within the drawer-receiving receptacle, into and from a closed position and through a range of opened positions. The drawer has an interior space and walls including an outer wall and two side walls, the side walls having coplanar upper edges defining an upper plane. The footrest is mounted to a selected one of the outer and side walls, near the upper edge of the selected wall, so as to be pivotally movable through at least about 90° of pivotal motion, when the drawer is moved sufficiently into the range of opened positions for the footrest to clear the margin of the drawer-receiving receptacle, from and into a lowered position and through a range of raised positions.

In the lowered position, the footrest extends horizontally with the expansive, foot-supportive panel covering at least a substantial part of the interior space, and substantially all of the footrest lies beneath the upper plane defined by the upper edges of the side walls so as to permit the drawer to be horizontally moved into and from the closed position without interference from the footrest. In the range of raised positions, the footrest allows access to the same part of the interior space. Preferably, the combination comprises means for biasing the footrest toward the lowered position but permitting the footrest to be pivotally moved into and from the lowered position and through the range of raised positions.

Preferably, the combination further comprises means mounted to at least one of the outer and side walls for limiting pivotal movement of the footrest toward the lowered position. If the footrest is mounted to the front wall, the limiting means may comprise at least one bracket mounted to one of the side walls, within the interior space. If the footrest is mounted to a given one of the side walls, the limiting means may comprise at least one bracket mounted to the other one of the side walls, within the interior space. Whether the footrest is mounted to the front wall or to a given one of the side walls, the limiting means may comprise a pair of brackets. Whether one bracket or a pair of brackets are used, each bracket has an upper flange limiting pivotal movement of the footrest toward the lowered position.

The drawer may have an inner wall and may comprise a pair of file-hanging rails mounted within the drawer so as to extend between the outer and inner walls or between the side walls, near the other walls and below the upper plane, and arranged to accommodate file folders with upper hangers extending above the file-hanging rails by distances less than a given distance for hanging such folders from the file-hanging rails. In the lowered position, the footrest may be then spaced above the file-hanging rails by distances not less than the given distance so as not to interfere with such folders hanging from the file-hanging rails.

These and other objects, features, and advantages of this invention are evident from the following description of two contemplated embodiments of this invention with reference to the accompanying drawings.

BRIEF DESCRIPTION OF THE DRAWINGS

FIG. 1 is a fragmentary, perspective view of a desk having a drawer provided with a footrest according to one contemplated embodiment of this invention. Legs and feet of a user are shown in broken lines.

FIG. 2, on an enlarged scale compared to FIG. 1, is a fragmentary, perspective view of the desk, the drawer, and the footrest. Pivotal movement of the footrest is suggested by a wide arrow.

FIG. 3, on a similar scale, is a fragmentary, sectional view taken along line 3—3 of FIG. 2, in a direction indicated by arrows.

FIG. 4, on a smaller scale compared to FIGS. 2 and 3, is a fragmentary, plan view of a desk having a drawer provided with a footrest according to an alternative embodiment of this invention.

DETAILED DESCRIPTION OF THE ILLUSTRATED EMBODIMENTS

As illustrated fragmentarily in FIGS. 1, 2, and 3, in one contemplated embodiment of this invention, a desk 10 is provided with a drawer-receiving receptacle 12 having a margin 14 framing the receptacle 12 and with a drawer 20, which is movable horizontally within the receptacle 12 for opening and closing the drawer 20, and is combined with a footrest 30. The drawer 20 is movable into and from a closed position and through a range of opened positions including the opened position of the drawer 20 in FIG. 1. Except for the footrest 30, associated hinges to be later described, and associated brackets to be later described, the desk 10 and the drawer 20 are conventional.

As illustrated in FIG. 2, the drawer 20 has an interior space 40 defined by the walls of the drawer 20, which has an outer or front wall 42, an inner or back wall 44 parallel to the outer wall 42, two side walls 46 parallel to each other and orthogonal to the outer wall 42 and to the inner wall 44, and a bottom wall 48 orthogonal to the other walls 42, 44, 46. The side walls 46 have coplanar upper edges 52 defining an upper plane. It is convenient to regard the outer wall 42 and the inner wall 44 as one pair of parallel walls and to regard the side walls 46 as another pair of parallel walls. As illustrated in FIG. 2, the upper edge 54 of the outer wall 42 and the upper edge 56 of the inner wall 44 are coplanar with the upper edges 52 of the side walls 46. In some drawers (not illustrated) with which this invention may be also used, the upper edges of the outer walls are not coplanar with but are higher than the upper edges of the side walls, and the upper edge of the inner wall also may be not coplanar with the upper edges of the side walls.

The footrest 30 comprises a substantially rectangular, substantially rigid, foot-supported panel 60, which is made from wood, plywood, plastic, or metal, wood being illustrated, and a thin pad 62, which is affixed by an adhesive layer 64 or otherwise to an outer surface of the panel 60 so as to cushion the footrest 30. The pad 62 may have a core 66 made from a suitable foam, such as a polyurethane foam, and an outer cover 68 made from a natural or synthetic leather or from a suitable fabric, such as a polyester fabric. Alternatively, the footrest 30 may comprise a rigid frame (not shown) made from wood, plastic, or metal and a cloth or webbing panel (not shown) mounted edgewise to the frame and made from a natural or synthetic fabric or other material.

The footrest 30 is mounted pivotally to the outer wall 42, near the upper edge 54 of the outer wall 42, so as to be pivotally movable through at least about 90° of pivotal motion, when the drawer 20 is moved sufficiently into the range of opened positions for the footrest 30 to clear the margin 14 of the drawer-receiving receptacle 12, from and into a lowered position and through a range of raised positions. The footrest 30 is mounted pivotally to the outer wall 42, near a proximal edge of the footrest 30, via strap hinges 70, which are provided with torsion springs 72 for biasing the footrest 30 toward the lowered position. Rather than the strap hinges 70 with the torsion springs 72, a so-called piano hinge (not shown) with a torsion spring (not shown) may be alternatively used.

The hinges 70 have fixed-length straps 74 secured to the panel 60, on the panel surface opposite to the pad 62, and adjustable-length straps 76 secured to the outer wall 42, on the inside surface of the outer wall 42. Each adjustable-length strap 76 has a lower member 80 having an upright portion 82 and a lower flange 84, which is secured to the upper surface of the bottom wall 48 of the drawer 20 via a fastener 86, such as a screw or a rivet. Each adjustable-length strap 76 has an upper member 88 having a vertical slot 90 enabling the upper member 88 to be adjustably positioned over the upright portion 82 of the lower member 80 as a similar fastener 86 is used to secure the upper member 88 to the lower member 80 and to secure the respective members 80, 88, to the outer wall 42.

The upper member 88 should be adjustably positioned over the upright portion 82 of the lower member 80 to provide that, in the lowered position, substantially all of the footrest 30 at its proximal edge lies beneath the upper plane defined by the upper edges 52 of the side walls 46 so as to permit the drawer 20 to be horizontally moved into and from the closed position without interference from the footrest 30. Moreover, in the lowered position, the footrest 30 extends horizontally with the panel 60 covering at least a substantial part of the interior space 40 of the drawer 20. In the range of raised positions, the footrest 30 allows access to the same pan of the interior space 40 of the drawer 20, in other words to the part that is covered by the panel 60 in the lowered position.

As means for limiting pivotal movement of the footrest 30 toward the lowered position, two adjustable-length brackets 100 are mounted, each bracket 100 being mounted to a selected one of the side walls 46, between the outer wall 42 and the inner wall 44. Each bracket 100 has a lower member 102 having an upright portion 104 with a lower flange 106, which is secured to the bottom wall 48 of the drawer 20 via a fastener 108, such as a screw or a rivet, and an upper member 110, which has an upright portion 112 with an upper flange 114 and with a vertical slot 116 enabling the upright portion 112 of the upper member 110 to be adjustably positioned over the upright portion 104 of the lower member 102 as a similar fastener 108 is used to secure the upper member 110 to the lower member 102 and to secure the respective members 102, 110, to the selected one of the side walls 46 of the drawer 20. As illustrated, a strip 118 of double-sided adhesive tape 18 may be used to secure each lower member 102 temporarily, until such lower member 102 is secured by the fasteners 108. Moreover, in some installations, the adhesive tape strips 118 may suffice to secure the brackets 100 without the fasteners 108.

As illustrated, the drawer 20 is provided with a pair of file-hanging rails 120, which are mounted via brackets 122 (one illustrated) secured to the bottom wall 48 or otherwise, so as to extend between the outer wall 42 and the inner wall 44, near the side walls 46 and below the upper plane defined by the upper edges 52 of the side walls 46. As illustrated, the fasteners 86 securing the hinge flanges 84 to the bottom wall 48 may be also used to secure one of the brackets 122 thereto. The file-hanging rails 120 are arranged to accommodate file folders 124 with upper hangers 126 extending above the file-hanging rails 120 by distances less than a given distance (e.g. one and one-half inches) for hanging such folders 124 from the file-hanging rails 120. Such rails 120, such brackets 122, and such folders 124 with upper hangers 126 are conventional.

The adjustable-length straps 76 of the hinges 70 and the adjustable-length brackets 100 should be suitably adjusted to provide that, in the lowered position, the footrest 30 extends horizontally with the panel 60 covering at least a substantial part of the interior space 40 of the drawer 20, to provide that, in the lowered position, substantially all of the footrest 30 at its proximal edge lies beneath the upper plane defined by the upper edges 52 of the side walls 46 so as to permit the drawer 20 to be horizontally moved into and from the closed position without interference from the footrest 30, and to provide that, in the lowered position, the footrest 30 is spaced above the file-hanging rails 120 by distances not less than the given distance, so as not to interfere with upper hangers 126 of file folders 124 hanging from the file-hanging rails 120. In the range of raised positions, the footrest 30 allows access to the same part of the interior space 40 of the drawer 20, in other words to the part that is covered by the panel 60 in the lowered position.

As illustrated in FIG. 4, in an alternative embodiment of this invention, the footrest 30 may be alternatively mounted to the upper edge 52 of a selected one of the side walls 46, via the strap hinges 70, with the brackets 100 mounted to the other one of the side walls 46. It may be then useful to substitute adjustable-length straps (not shown) similar to the adjustable-length straps 76, for the fixed-length straps, so as to accommodate a range of possible widths for the drawer 20.

Various modifications may be made in either of the respective embodiments described above without departing from the scope and spirit of this invention.

I claim:

1. A combination comprising a desk, credenza, or similar article of furniture and a footrest having an expansive, foot-supportive panel, the article having a drawer-receiving receptacle having a margin, the article having a drawer movable horizontally within the drawer-receiving receptacle, into and from a closed position and through a range of opened positions, the drawer having an interior space and having walls including an outer wall and two side walls, the side walls having coplanar upper edges defining an upper plane, the footrest being mounted to a wall selected from the outer and side walls, near the upper edge of the selected wall, so as to be pivotally movable through at least about 90° of pivotal motion, when the drawer is moved sufficiently into the range of opened positions for the footrest to clear the margin of the drawer-receiving receptacle, from and into a lowered position wherein the footrest extends horizontally with the expansive, foot-supportive panel covering at least a substantial part of the interior space, and wherein substantially all of the footrest lies beneath the upper plane defined by the upper edges of the side walls so as to permit the drawer to be horizontally moved into and from the closed position without interference from the footrest and through a range of raised positions wherein the footrest allows access to the same part of the interior space, the combination further comprising means for biasing the footrest toward the lowered position but permitting the footrest to be pivotally moved into and from the lowered position and through the range of raised positions.

2. The combination of claim 1 wherein the combination further comprises means mounted to at least one of the outer and side walls for limiting pivotal movement of the footrest toward the lowered position.

3. The combination of claim 2 wherein the footrest is mounted to the front wall, the limiting means comprising at least one bracket mounted to one of the side walls, within the interior space, the bracket having an upper flange limiting pivotal movement of the footrest toward the lowered position.

4. The combination of claim 2 wherein the footrest is mounted to the front wall, the limiting means comprising a pair of brackets, each mounted to a respective one of the side walls, within the interior space, each bracket having an upper flange limiting pivotal movement of the footrest toward the lowered position.

5. The combination of claim 2 wherein the footrest is mounted to a given one of the side walls, the limiting means comprising at least one bracket mounted to the other one of the side walls, within the interior space, the bracket having an upper flange limiting pivotal movement of the footrest toward the lowered position.

6. The combination of claim 2 wherein the footrest is mounted to a given one of the side walls, the limiting means comprising a pair of brackets mounted to the other one of the side walls, within the interior space, each bracket having an upper flange limiting pivotal movement of the footrest toward the lowered position.

7. A combination comprising a desk, credenza, or similar article of furniture and a footrest having an expansive, foot-supportive panel, the article having a drawer-receiving receptacle having a margin, the article having a drawer movable horizontally within the drawer-receiving receptacle, into and from a closed position and through a range of opened positions, the drawer having an interior space and having walls including an outer wall, an inner wall, and two side walls, the side walls having coplanar upper edges defining an upper plane, the drawer comprising a pair of file-hanging rails mounted within the drawer so as to extend between the outer and inner walls, near the side walls and below the upper plane, the file-hanging rails being arranged to accommodate file folders with upper hangers extending above the file-hanging rails by distances less than a given distance for hanging such folders from the file-hanging rails, the footrest being mounted to a wall selected from the side walls, near the upper edge of the selected wall, so as to be pivotally movable through at least about 90° of pivotal motion, when the drawer is moved sufficiently into the range of opened positions for the footrest to clear the margin of the drawer-receiving receptacle, from and into a lowered position wherein the footrest extends horizontally with the expansive, foot-supportive panel covering at least a substantial part of the interior space and through a range of raised positions wherein the footrest allows access to the same part of the interior space, the combination further comprising means for limiting pivotal movement of the footrest toward the lowered position so that substantially all of the footrest in the lowered position lies beneath the upper plane defined by the upper edges of the side walls, so as to permit the drawer to be horizontally moved into and from the closed position without interference from the footrest, and so that the footrest in the lowered position is spaced above the file-hanging rails by distances not less than the given distance, so as not to interfere with such folders hanging from the file-hanging rails.

8. A combination comprising a desk, credenza, or similar article of furniture and a footrest having an expansive, foot-supportive panel, the article having a drawer-receiving receptacle having a margin, the article having a drawer movable horizontally within the drawer-receiving receptacle, into and from a closed position and through a range of opened positions, the drawer having an interior space and having walls including an outer wall, an inner wall, and two side walls, the side walls having coplanar upper edges defining an upper plane, the drawer comprising a pair of file-hanging rails mounted within the drawer so as to extend between the outer and inner walls, near the side walls and below the upper plane, the file-hanging rails being arranged to accommodate file folders with upper hangers extending above the file-hanging rails by distances less than a given distance for hanging such folders from the file-hanging rails, the footrest being mounted to the outer wall, near the upper edge of the outer wall, so as to be pivotally movable through at least about 90° of pivotal motion, when the drawer is moved sufficiently into the range of opened positions for the footrest to clear the margin of the drawer-receiving receptacle, from and into a lowered position wherein the footrest extends horizontally with the expansive, foot-supportive panel covering at least a substantial part of the interior space and through a range of raised positions wherein the footrest allows access to the same part of the interior space, the combination further comprising means for limiting pivotal movement of the footrest toward the lowered position so that substantially all of the footrest in the lowered position lies beneath the upper plane defined by the upper edges of the side walls, so as to permit the drawer to be horizontally moved into and from the closed position without interference from the footrest, and so that the footrest in the lowered position is spaced above the file-hanging rails by distances not less than the given distance so as not to interfere with such folders hanging from the file-hanging rails.

9. A combination comprising a desk, credenza, or similar article of furniture and a footrest having an expansive, foot-supportive panel, the article having a drawer-receiving receptacle having a margin, the article having a drawer movable horizontally within the drawer-receiving receptacle, into and from a closed position and through a range of opened positions, the drawer having an interior space and having walls including an outer wall, an inner wall, and two side walls, the outer and inner walls constituting one pair of parallel walls and the side walls constituting another pair of parallel walls, the side walls having coplanar upper edges defining an upper plane, the drawer comprising a pair of file-hanging rails mounted within the drawer so as to extend between the walls of a given pair, near the respective walls of the other pair and below the upper plane, the file-hanging rails being arranged to accommodate file folders with upper hangers extending above the file-hanging rails by distances less than a given distance for hanging such folders from the file-hanging rails, the footrest being mounted to a wall selected from the outer and side walls, near the upper edge of the selected wall, so as to be pivotally movable through at least about 90° of pivotal motion, when the drawer is moved sufficiently into the range of opened positions for the footrest to clear the margin of the drawer-receiving receptacle, from and into a lowered position wherein the footrest extends horizontally with the expansive, foot-supportive panel covering at least a substantial part of the interior space and through a range of raised positions wherein the footrest allows access to the same part of the interior space, the combination further comprising means for limiting pivotal movement of the footrest toward the lowered position so that substantially all of the footrest in the lowered position lies beneath the upper plane defined by the upper edges of the side walls, so as to permit the drawer to be horizontally moved into and from the closed position without interference from the footrest, and so that the footrest in the lowered position is spaced above the file-hanging rails by distances not less than the given distance so as not to interfere with such folders hanging from the file-hanging rails.

* * * * *